United States Patent [19]

Johnson

[11] 3,995,321

[45] Dec. 7, 1976

[54] DISPOSABLE PROTECTIVE BIB

[75] Inventor: Sally Johnson, Hohokus, N.J.

[73] Assignee: Lawrence Peska Associates, Inc., New York, N.Y. ; a part interest

[22] Filed: Apr. 28, 1976

[21] Appl. No.: 681,219

[52] U.S. Cl. ..... 2/49 R

[51] Int. Cl.[2] ..... A41B 13/10

[58] Field of Search ..... 2/49 R, 49 A

[56] References Cited

UNITED STATES PATENTS

| | | | |
|---|---|---|---|
| 590,991 | 10/1897 | Lenhart | 2/49 R |
| 2,244,656 | 6/1941 | Asch | 2/49 R |
| 2,532,932 | 12/1950 | Neiswander | 2/49 R |
| 2,551,907 | 5/1951 | Serebrin | 2/49 R |
| 2,643,384 | 6/1953 | Thompson | 2/49 R |
| 3,146,464 | 9/1964 | Burnett | 2/49 R |
| 3,328,807 | 7/1967 | Strauss | 2/49 R |

*Primary Examiner*—Alfred R. Guest
*Attorney, Agent, or Firm*—Joel Halpern

[57] ABSTRACT

A disposable protective bib includes a disposable substantially rectangular sheet of soft flexible material having a hole and slit adapted to accommodate the user's neck adjacent one extremity and a transversely extending pocket member for catching spilled and dropped food adjacent the other extremity of the sheet. An adhesive tab is provided for securing the slit closed around the user's neck when the bib is in use, and a plurality of adhesive elements are provided on the pocket member for securing same in an open food catching position to a supporting surface.

4 Claims, 4 Drawing Figures

3

DISPOSABLE PROTECTIVE BIB

BACKGROUND OF THE INVENTION

1. Field of the Invention

The present invention relates to disposable protective bibs, and more particularly, to disposable protective bibs having a pocket member as an integral part thereof which is adapted to catch falling and spilled food.

2. Description of the Prior Art

The prior art discloses disposable protective bibs having a pocket member for catching falling and spilled food. Provision is not made to maintain the pocket member in an open food receiving position and, therefore, the pockets are largely ineffective. A typical bib of this type is disclosed in U.S. Pat. No. 3,328,807 to K. Strauss, issued July 4, 1967. A fold line is provided and the edge of the bib is folded up therealong and secured with adhesive to form a pocket.

U.S. Pat. No. 3,329,969 to J. F. Farber, et al., issued July 11, 1967, teaches a bib having a pocket formed along an edge thereof. The bib may be used as an article for wiping the user's face after eating. However, the use of the bib in this manner may prove to be unsatisfactory if soiled badly during eating.

SUMMARY OF THE INVENTION

Therefore, it is a primary object of the present invention to provide a disposable protective bib having a food catching pocket member as an integral part thereof which is capable of being maintained in an open food-receiving position when in use.

Another object of the invention is to provide a disposable protective bib of the character described having also a separable towel element.

These objects, as well as further objects and advantages of the present invention will become readily apparent after reading the description of a non-limiting illustrative embodiment and the accompanying drawing.

According to the present invention there is provided a disposable protective bib comprising; a disposable substantially rectangular sheet of flexible material having an opening adjacent one transverse edge thereof dimensioned to fit around the neck of a child, the sheet having a slit therein extending radially from the opening to the edge, a pocket member having a transverse opening therein formed adjacent the other transverse edge of said sheet, an adhesive tab affixed adjacent one edge of the slit having a free end thereof adapted to transverse the slit and to be detachably affixed adjacent the other edge thereof to thereby secure the edges in juxtaposed relation, and a plurality of adhesive elements secured to the pocket member along an edge defining the opening therein and adapted to be affixed at the free ends thereof to an external supporting surface to thereby maintain said pocket in an open food-catching position.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
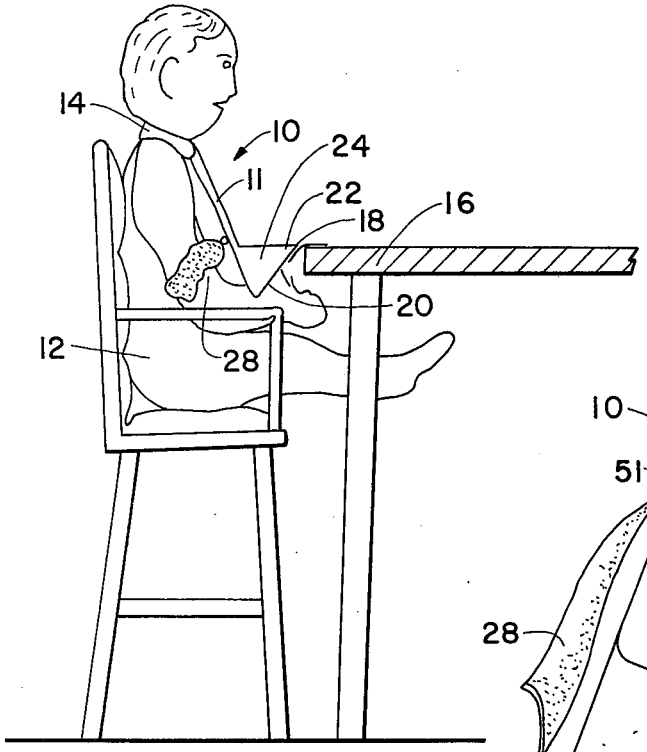
FIG. 1 is a side view of the disposable protective bib embodying the features of the present invention in use by a child and affixed to a table.

Referring to the drawings, and more particularly to FIG. 1 thereof, there is shown generally, as indicated by reference numeral 10, a disposable protective bib worn by a child 12. The bib includes a substantially rectangular sheet 11 of soft flexible absorbent material. The sheet 11 is affixed at one end 14 thereof to a child and is secured to a table 16 at its other end 18. The end 18 of the sheet 11 provides a pocket member 20 having a transverse opening 22 therein. The pocket member 20 is adapted to catch and retain falling and spilled food. Substantially triangular side portions 24 connect the pocket with the sheet 11 to thereby enclose the sides. An absorbent towel cloth 28 is shown as being detachably affixed to the sheet 11. One means for securing the towel to the sheet is the provision of mating velcro strips on both the towel and sheet.

Figure 2:
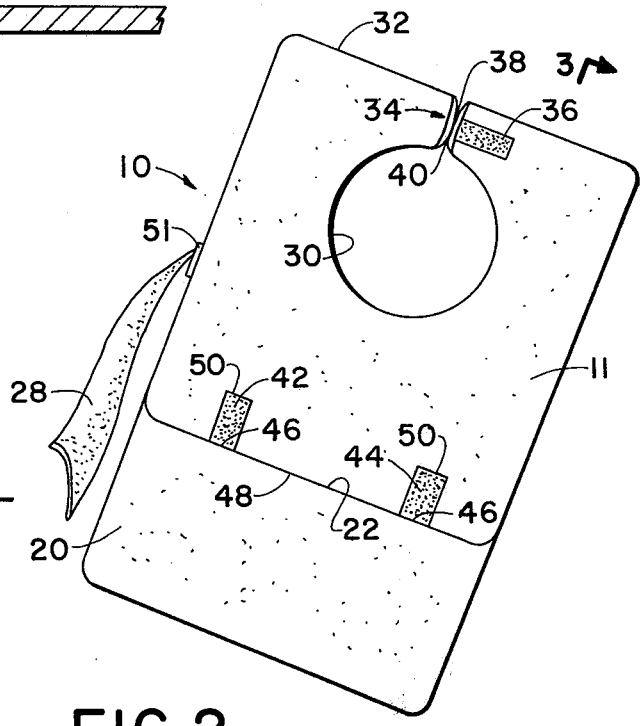
FIG. 2 is a perspective view of the disposable protective bib of the invention.

FIG. 2 illustrates the bib 10. The sheet 11 includes an opening 30 adjacent to an edge 32 thereof and a slit 34 which extends radially from the opening to the edge of the sheet. An adhesive tab 36 is affixed at one end thereof to the sheet along an edge 38 of the slit 34. The free end of the tab 36 is adapted to be removably affixed adjacent the other edge 40 of the slit 34 to thereby secure the edges 38 and 40 closely adjacent each other when in use. A pair of adhesive elements 42 and 44 are each affixed at one end 46 thereof to the transverse edge 48 of the pocket 20. The opposite free ends 50 of the elements 42 and 44 are adapted to be secured to a supporting surface such as the table 16 shown in FIG. 1. The adhesive elements 42 and 44, when secured to such a supporting surface, serve to maintain the pocket member 20 in an open food receiving position. The absorbent cloth 28 may, as an alternative to the use of velcro strips, be detachably affixed to the bib by means of perforations 51 permitting the user to separate and use the cloth 28 for cleaning purposes.

Figure 3:
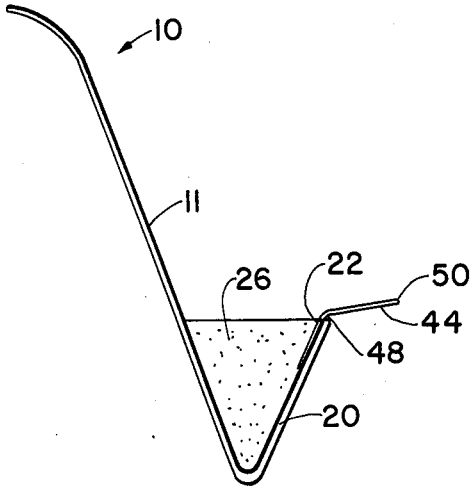
FIG. 3 is a cross-sectional view of the disposable protective bib shown in FIG. 2 taken along the line 3—3 thereof.

FIG. 3 clearly illustrates the adhesive element 44 extending from the edge 48 of the pocket 20.

Figure 4:
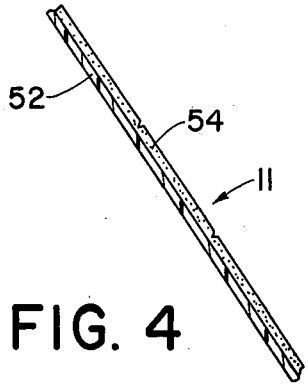
FIG. 4 is a fragmentary cross-sectional view of the disposable protective bib of FIG. 3.

FIG. 4 illustrates the construction of the sheet 11. A moisture impervious or repellent layer 52 of a suitable plastics material is bonded during manufacture to an absorbent layer 54 made of cloth or an equivalent absorbent paper material. As a result, the bib 10 is capable of absorbing spilled liquids and keeping the user dry.

It will be understood that various changes in the details, materials, and arrangements of parts which have been herein described and illustrated in order to explain the nature of the invention may be made by those skilled in the art within the principles and scope of the invention.

Having thus set forth the nature of the invention, what is claimed is:

1. A disposable protective bib comprising:

a disposable substantially rectangular sheet of flexible material having an opening adjacent one transverse edge thereof dimensioned to fit around the neck of a child, said sheet having a slit therein extending radially from said opening to said edge;

a pocket member having a transverse opening therein formed adjacent the other transverse edge of said sheet;

an adhesive tab affixed adjacent one edge of said slit having a free end thereof adapted to transverse said slit and to be detachably affixed adjacent the other edge thereof to thereby secure said edges in juxtaposed relation;

and a plurality of adhesive elements secured to said pocket member along an edge defining the opening therein said elements having free ends extending beyond said edge and adapted to be affixed to an external supporting surface to thereby maintain said pocket in an open food-catching position.

2. A disposable protective bib according to claim 1, wherein said sheet comprises an absorbent layer and a moisture repellent layer bonded together in coextensive overlying relation.

3. A disposable protective bib according to claim 1, including an absorbent towel cloth detachably affixed thereto.

4. A disposable protective bib according to claim 1, wherein said pocket member is integral with said sheet and extends upwardly and angularly from said other transverse edge thereof to present a substantially triangular receptacle when in use.

* * * * *